United States Patent [19]

Lock et al.

[11] 4,141,515

[45] Feb. 27, 1979

[54] AUTOMATED LAYER SEPARATOR DELIVERY SYSTEM FOR OPTICAL WAVEGUIDE WINDING

[75] Inventors: William E. Lock, Horseheads; Jesse C. Thrower, Painted Post, both of N.Y.

[73] Assignee: Corning Glass Works, Corning, N.Y.

[21] Appl. No.: 821,135

[22] Filed: Aug. 2, 1977

[51] Int. Cl.[2] ..... B65H 54/28

[52] U.S. Cl. ..... 242/54 R; 242/18 G; 242/56 R; 242/78.1

[58] Field of Search ..... 242/55, 78.1, 56 R, 242/54 R, 18 G, 47

[56] References Cited

U.S. PATENT DOCUMENTS

| | | | |
|---|---|---|---|
| 3,163,066 | 12/1964 | Beaulieu et al. | 242/56 R X |
| 3,495,782 | 2/1970 | Nelson et al. | 242/56 R |
| 3,871,594 | 3/1975 | O'Neil et al. | 242/78.1 |

*Primary Examiner*—George F. Mautz
*Attorney, Agent, or Firm*—Walter S. Zebrowski; Clarence R. Patty, Jr.; Richard E. Kurtz

[57] ABSTRACT

A system for delivering separator material to a drum upon which optical waveguides are wound. The sheet material is delivered to the vicinity of the drum through a partially-enclosed guide and cut to length. Air jets are provided for urging the severed sheet material against the drum so that a succeeding layer of waveguides can be wound upon it.

12 Claims, 4 Drawing Figures

AUTOMATED LAYER SEPARATOR DELIVERY SYSTEM FOR OPTICAL WAVEGUIDE WINDING

BACKGROUND OF THE INVENTION

The present invention relates to layer separator delivery systems, and more particularly to an automated system for delivering separators to a drum utilizing air pressure.

According to present practices optical waveguides are drawn into elongate strands from a blank, then coated, tested for strength and wound upon spools or drums. Owing to the small diameter and relatively brittle nature of the waveguides and further to the necessity of preserving the external coating thereon, it is customary to insert separators between successive waveguide layers. To accomplish this strips of thin paper are cut to an appropriate size and when a layer of waveguide is completed a separator sheet is inserted at the "pinch point" where the strand meets the drum. The drum is then rotated again whereby the waveguide wraps about the separator, overlying it so as to hold it in place while the new waveguide layer is wound upon the drum.

The function of the separator is to keep successive waveguide layers from becoming entangled and/or abrading one another. Accordingly, each time a layer is wound upon a drum a new separator is manually inserted. This task normally fully occupies one individual, necessitating the employment of an extra individual for each waveguide drum being wound.

Although the procedure just described is satisfactory from a standpoint of the proper insertion of separators, it is apparent that the production of waveguides is slowed considerably.

One way to eliminate the need for hand insertion of separators would be to develop a waveguide coating which would be resistant to damage due to entanglement or abrasion. Such a coating has not yet been developed. Accordingly, it will be appreciated that it would be highly advantageous to provide means for automatically inserting sheets of separator material between successive layers of optical waveguide as it is wound upon a drum.

It is therefore an object of the present invention to provide means for automatically inserting sheet separator material between waveguide layers.

Another object is to provide improved means for applying separator materials to a drum upon which an optical waveguide is being wound.

Yet another object is to provide an automated system for delivering separator sheets of the proper length to a drum upon which a waveguide is being wound.

SUMMARY OF THE INVENTION

Briefly stated, in accordance with one aspect of the invention the foregoing objects are achieved by providing a supply roll of separator sheet material along with an advancing mechanism for engaging the material and urging it toward a cutoff station. A channel-like guide directs the material to the cutoff station, and from there to the vicinity of a drum upon which a waveguide is wound. Nozzles discharging compressed air are disposed near the distal end of the guide means and direct a stream of compressed air against the sheet material to urge it from the guide. Switching means are provided to operate the cutoff station at appropriate times so that separator sheets of the correct length are transferred to the surface of the rotating drum.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
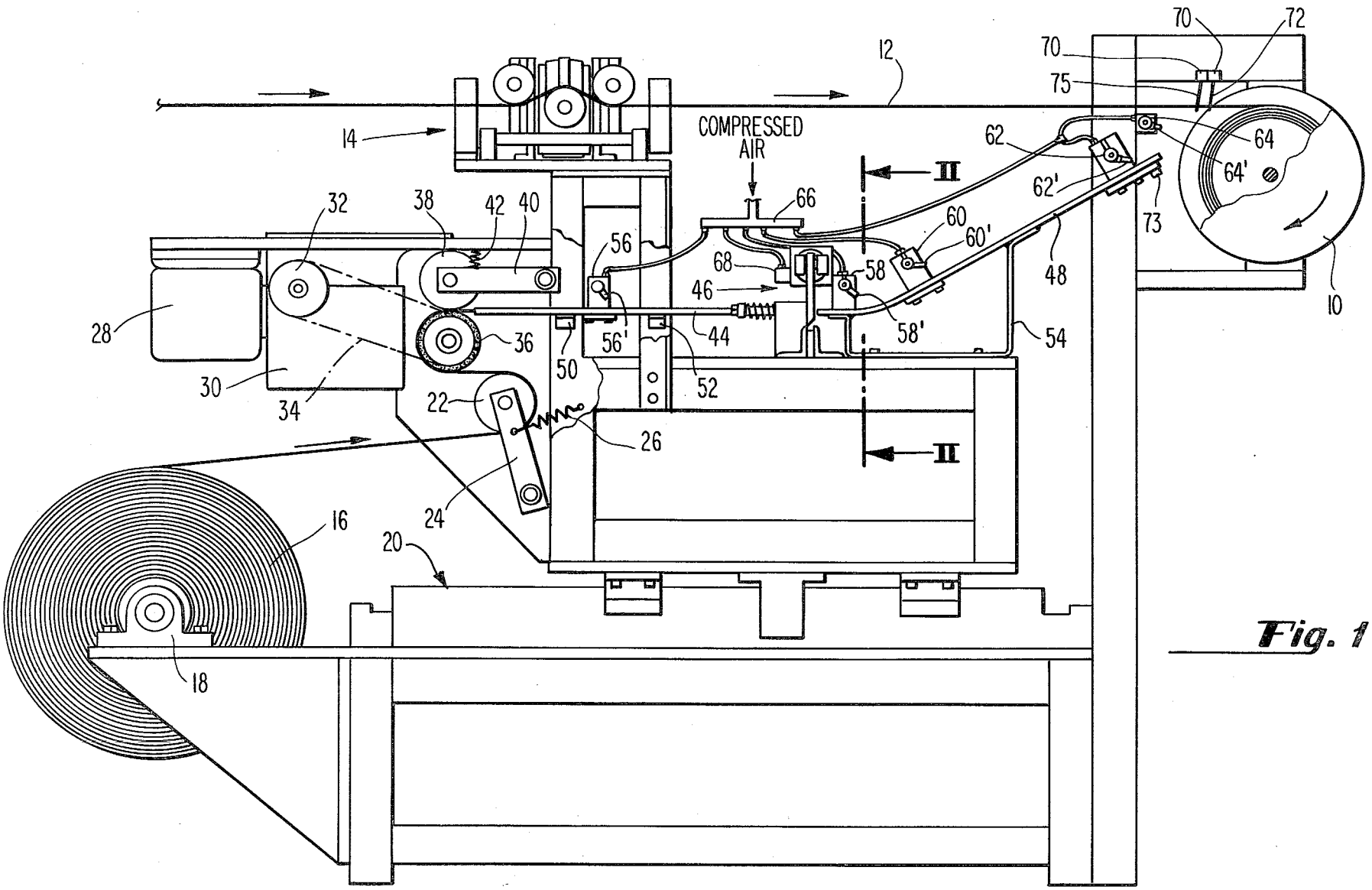
FIG. 1 is an elevational view of an apparatus for practicing the invention.

FIG. 1 represents a side view of a system for automatically inserting a sheet of separator material upon a drum 10 which receives an elongate optical waveguide 12. The waveguide is wound back and forth upon the surface of drum 10 to form a series of layers, in conventional fashion. A tensioning device generally indicated at 14 is provided for applying an appropriate tension to the waveguide to assure proper winding. Other apparatus, not shown in the Figure, draws the waveguide from a heated blank of glass or the like and applies an appropriate coating to the surface of the waveguide.

As is known to those skilled in the art, it is necessary to interpose a layer of a thin separator material between successive layers of the waveguide as it is wound upon drum 10. A roll 16 of such material, which may comprise a thin, tough paper cut to a width slightly in excess of the width of the waveguide layers being formed upon the drum, is rotatably journaled in a pillow block 18. Block 18 is in turn supported upon a frame 20 which provides a common support for various elements of the system. An idler roll 22 is supported by a pivoted arm 24, and biased to a position away from roll 16 by a coil spring 26.

Means are provided for periodically advancing the separator material, and include an electric motor 28 coupled through a gear box 30 to a drive sprocket 32. A chain or belt 34 is used to drivingly couple sprocket 32 to one end of a drive roll 36 which frictionally engages the separator material. In order to enhance the engagement of the separator material a mating roll 38 mounted upon a pivoted arm 40 is urged against drive roll 36 by means of spring 42.

A channel-like guide member 44 conducts the separator material from the drive roll to a cutoff station which includes a shear generally indicated at 46. At the other side of the shear another channel-like guide 48 is provided for directing the distal end of the separator to a point in close proximity to the surface of drum 10. Appropriate brackets 50, 52 and 54 are provided to support the guides in the proper position.

Stationed at various points along the path of the separator are a plurality of nozzle means 56, 58, 60, 62 and 64 having air jets 56', 58', 60', 62' and 64' respectively. While the total of five such nozzle means are depicted in the Figure it should be understood that the number and orientation of the nozzle means vary depending upon the individual characteristics and use of the apparatus. Each of the nozzle means is coupled to a manifold 66 which is connected to a source of compressed air. Manifold 66 is also connected to a solenoid-actuated valve 68, and supplies compressed air for operating shear 46.

From an inspection of the Figure, it will be seen that the jets 56', 58', 60' and 62' of the respective nozzle means are directed obliquely to the surface of the guides, jet 62' being oriented toward the distal end of guide means 48. In the embodiment depicted in FIG. 1 additional nozzle means 64 is directed toward the surface of drum 10 at a point in advance of the "pinch point" between the strand and the drum. It has been found that by disposing the nozzle means in the fashion indicated a length of thin, flexible separator material can be urged along an elongate guideway, and then urged outwardly from the guide onto the surface of drum 10.

In order to provide proper timing and control of the illustrated system limit switches 70 and 72 are disposed at either extreme of the travel of waveguide 12 as it traverses the surface of drum 10. Further, another switch 73 is provided at or near the end of guide means 48 and responds to the presence of the separator material.

Figure 2:
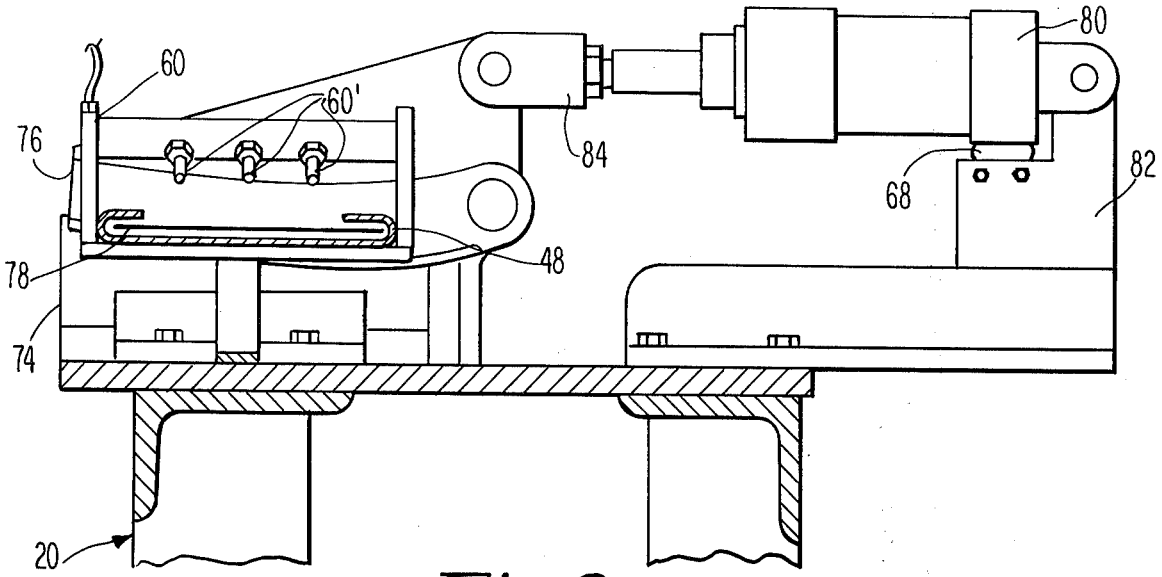
FIG. 2 is a view taken at II—II of FIG. 1.

Turning now to FIG. 2, there is shown a view of FIG. 1 which illustrates further aspects of the invention. Supported by machine frame 20 is an anvil 74 which cooperates with a pivoted blade 76 to form a shear extending transversely across the path of separator material 78. A plurality of jets 60' extend downwardly from nozzle means 60 to direct a continuous stream of compressed air upon the upper surface of separator 78.

The cross-sectional configuration of guide means 48 is apparent from the Figure. Like guide means 44 it is formed in a shape which may be defined as a channel-like configuration, having upstanding edges which are doubled over to form flanges which define an upper surface extending generally parallel to the lower surface. The edges do not meet, so that the upper surface of the channel-like guide is open to allow the streams of compressed air to impinge upon the separator material. At the same time, the material is captured within the guide due to the wrap-around configuration of the edges.

A pneumatic cylinder 80 receives air from a solenoid-actuated valve 68 which is coupled to a support 82 in common with the cylinder. Cylinder 80 is coupled to blade 76 by means of a clevis 84. Accordingly, by operating solenoid valve 68 with properly-timed electrical signals blade 76 may be rapidly raised and lowered in order to allow separator material to be fed along the guide means, and then cut to the proper length.

The operation of the depicted system will now be explained in detail, making reference to the above-enumerated elements of the Figures. It will be assumed that at least one layer of waveguide 12 has been wound upon drum 10, and the end of the separator material threaded about idler roll 22 and between rolls 36 and 38. When the system is first energized motor 28 is actuated, rotating drive sprocket 32 and accordingly turning drive roll 36 through the intervening mechanism of belt or chain 34. The frictional contact of roll 36 upon the separator material as it passes between rolls 36 and 38 draws the material from roll 16, while an appropriate tension is maintained upon the material by idler roll 22. By thus taking up the slack in the separator material, roll 22 reduces the tendency of the material to break when drive roll 36 commences turning.

As the end of the separator material passes along guide means 44 it encounters a jet of compressed air from nozzle means 56. The compressed air urges the material along the guide means, incidentally keeping it flat and opposing the buckling which might otherwise occur.

It will be assumed that due to the status of solenoid valve 66 shear 46 is open, and does not impede the progress of the distal end of the separator material. Accordingly, the material passes through the cutoff station and enters guide means 48. It then passes beneath nozzle means 58, 60 and 62, respectively, and ultimately contacts the sensing member of switch 73.

When the separator material encounters switch 73, drive motor 28 is deenergized and the separator material ceases to advance. Jets of compressed air continue to issue from the various nozzle means, keeping the separator material under a slight tension. Eventually waveguide 12 traverses drum 10 and reaches a position at one side or the other of the layer being wound. At this point the strand encounters one of the limit switches 70 and 72. As shown in the Figure the switches may include downwardly-depending arms 75, 77 which extend at either extreme of waveguide travel so that one of the switches is operated as the waveguide approaches the end of the drum but before it reverses direction to begin a new layer. When one of switches 70, 72 is operated it serves to enable cutoff solenoid 68. Compressed air is then applied to pneumatic cylinder 80 which forces the blade 76 of the shear rapidly downwardly, severing the separator material.

Upon operation of the shear, the severed length of the separator is freed to move forward at the urging of the streams of compressed air from the nozzle means. According to one preferred embodiment of the invention the distal end of the separator exits from the uppermost end of the guide means 48 at the urging of nozzle means 58, 60 and 62 and is propelled toward the "pinch point" where waveguide 12 makes contact with drum 10. The leading or distal edge of the separator is then physically pinched between the arriving waveguide and the previously-wound layer. As drum 10 rotates in the direction shown, the full length of the separator is drawn onto the drum and overlain by the waveguide. As the drum continues to turn the waveguide slowly traverses its surface until a complete layer is wound over the separator material.

It should now be apparent that the length of the separator material applied to drum 10 should be approximately equal to the circumference of the layers being wound. Obviously as more layers are wound the circumference increases; and it is possible to adjust the length of succeeding, severed separator strips to match the precise length required. In practice, however, it has been found that the length of the separator strip is not critical although it is preferred that the length of the strip be at least equal to the circumference of the layers so that the separator overlaps upon itself to a degree. Accordingly, while the length of a separator strip may be characterized as generally equivalent to the periphery of the wound layers, it will be understood that this is an approximation and need not be precisely adhered to.

The system of FIG. 1 may also be adapted to operate in a slightly different fashion from that just described. In particular, by utilizing nozzle means 64 a jet of air may be directed upon the surface of drum 10. Motor 28 operates as before to advance the separator material through the guide means 48. The separator then continues to advance until timer 88 times out, disabling motor 28. The time delay is adjusted so that the edge of the separator material advances to a point upon the surface of drum 10 and beneath nozzle means 64, but not far enough to encounter the pinch point between the newly-wound waveguide and the drum surface. Accordingly, the edge of the separator material will be frictionally urged against the surface of drum 10 by the pressure of the air issuing from nozzle means 64. Friction between the drum and the underside of the separator, along with the urging of compressed air issuing from the various other nozzle means, maintains the separator material in a state of slight tension. However, inasmuch as drive motor 28 has stopped the separator material is held in place between rolls 36 and 38 and cannot advance further.

When the waveguide strand re-traverses the drum it engages one of switches 70, 72 as explained hereinabove. The switches energize the cutoff solenoid 68, operating the shear and severing the tensioned separator material. As soon as the material is severed the friction between the leading edge of the material and the surface of drum 10 causes the material to be drawn upon the drum and up to the pinch point where it is overlain by newly-wound turns of waveguide. Actuation of switch 70 or 72 causes drive motor 28 to restart, advancing the separator material along guide means 48 and into frictional contact with drum 10.

Figure 3:
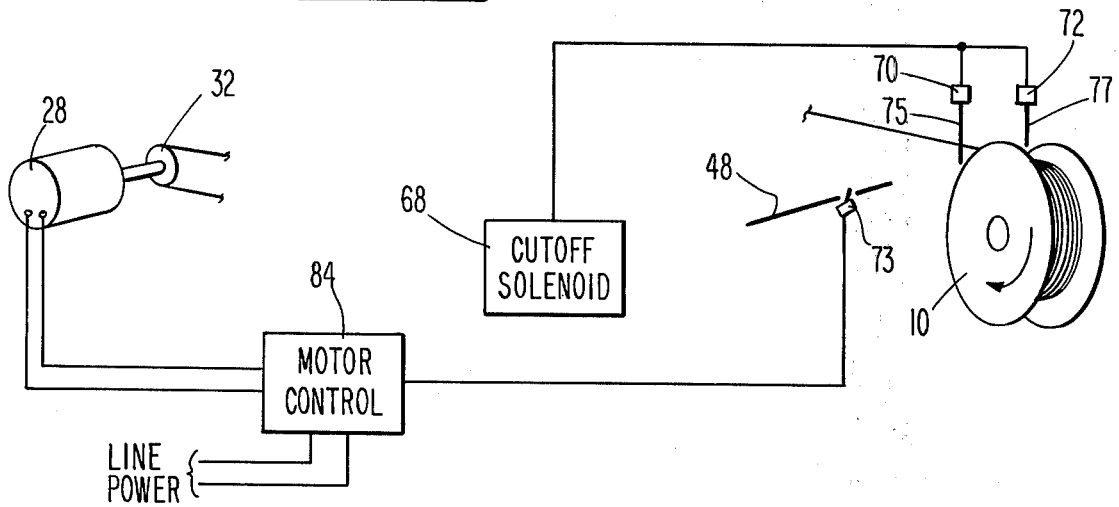
FIG. 3 is a schematic diagram illustrating the operation of the control system of one embodiment of the invention.

Turning now to FIG. 3 there is shown a schematic diagram more fully depicting the connecting of the various switches and drive means. Power from an outside source is applied to drive motor 28 through a motor control 84, which may be any of the common commercially-available controls. When energized by control 84 drive motor 28 turns the sprocket 32 to effect an advancing of the separator material, as described hereinabove. Operation of the control 84 is initiated by switch 73 which is disposed in proximity to guide means 48, as described above. Finally, cutoff solenoid 68 is operated by either of switches 70 or 72 in response to the traversing of the drum by the waveguide strand.

It will now be evident that, as soon as a length of separator material has been drawn from guide means 48 and onto drum 10, switch 73 is cleared to return to its quiescent position. In this position it energizes motor control 84, whereby drive motor 28 is operated to advance the separator material. As the distal end of the separator material moves up guide 48 it ultimately engages switch 73 to deenergize motor control 84. Accordingly, advancement of the separator material ceases. The system then remains inoperative until the waveguide being wound upon drum 10 nears one end of its travel along the drum. At this point the waveguide closes either switch 70 or 72, activating the cutoff solenoid 68 and effecting a severing of the separator material. As described above, as soon as the material is severed it is transferred to the pinch point of drum 10 and strand 12 by compressed air issuing from the nozzle means. This clears the switch, and the cycle repeats.

Figure 4:
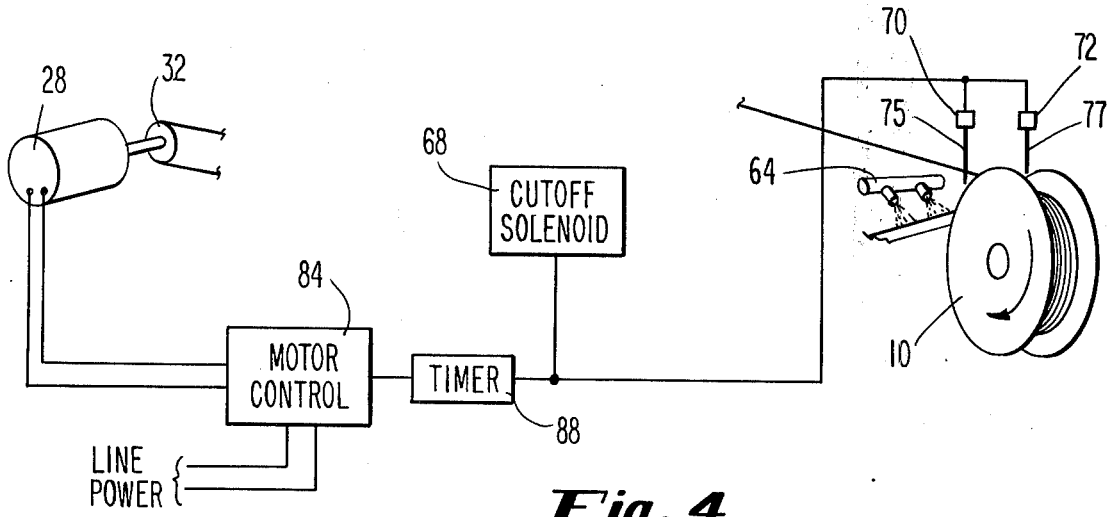
FIG. 4 is a schematic diagram of another embodiment of the control system.

FIG. 4 schematically illustrates a modification of the control system shown in FIG. 3. The system of FIG. 4 is particularly adapted to allow the leading edge of the separator material to be pressed against the surface of the drum 10 by jets of air from nozzle means 64 previous to its severance by shear 46. As before, current is applied to drive motor 28 through a motor control 84. Signals for operating the motor control are now received from a timer 88 interposed between the motor control and switches 70, 72. When the waveguide nears the end of its traverse along the surface of drum 10, it engages the arm of one of switches 70, 72 and operates the cutoff solenoid 68. A length of separator material which has been held in frictional contact with drum 10 is then freed to follow the surface of the drum as it rotates, ultimately reaching the pinch point of the waveguide. At the same time, timer 88 actuates motor control 84 to cause the separator material supply to be advanced for a predetermined time. It will be understood that by controlling the time interval during which motor 28 is operated, an appropriate length of separator material can be advanced along the guide means and into a position between nozzle means 64 and the surface of drum 10.

When timer 88 times out, the motor is deenergized and the separator material is restrained from further advancement by drive roll 36. The blast of air issuing from nozzle means 64 urges the newly advanced end of the separator material against the surface of drum 10. The frictional contact between the material and the drum tends to pull the material outwardly from the guide; however, since it is held fast by drive roll 36 it does not advance. When the waveguide traverses the drum to reach the end of a layer, it will operate switch 70 or 72. The signal thus produced will effect both the severing of the separator material, allowing it to wrap around drum 10, and the starting of motor 28 to advance a new length of material as has been described above.

Due to the relatively rapid takeup of the severed separator material upon drum 10 compared to the speed of motor 28, the drive motor may be energized simultaneously with the severing of the separator material without any overlap or interference between succeeding lengths of material.

From the foregoing it will now be appreciated that there has been disclosed an automated delivery system for applying separator material of the proper length in between succeeding layers of waveguide as it is wound upon a drum, without stopping or even slowing the winding operation. Further, and as will be evident from the foregoing description certain aspects of the invention are not limited to the particular details of the examples illustrated, and it is contemplated that other modifications or applications will occur to those skilled in the art. It is accordingly intended that the appended claims shall cover such modifications and applications as do not depart from the true spirit and scope of the invention.

What is claimed as new and desired to be secured by Letters Patent of the United States is:

1. Apparatus for automatically inserting a separator sheet between concentric layers of an optical waveguide being wound upon a drum, comprising:

a supply roll of separator sheet material;

advancing means for engaging and advancing the sheet material along a path in increments corresponding to the length of separator sheet required;

sensing means disposed adjacent said drum and responsive to the lateral position of the waveguide being wound for producing an enabling signal;

cutoff means disposed in said path and responsive to said enabling signal for severing said sheet material after the advancement thereof;

elongate guide means for retaining lengths of sheet material therein and conducting said sheet material from said cutoff means to the drum; and nozzle means disposed in proximate relationship to said guide means for directing a stream of compressed air against the sheet material to urge the sheet material outwardly from said guide means.

2. Apparatus according to claim 1, further including second guide means extending from said advancing means to said cutoff means for guiding said sheet material.

3. Apparatus according to claim 2, wherein said cutoff means comprises a reciprocating blade and stationary anvil operable to transversely shear said sheet material.

4. Apparatus according to claim 3, wherein said advancing means comprises an intermittently driven cylinder disposed in frictional contact with said sheet material.

5. Apparatus according to claim 4, further including a plurality of nozzle means oriented to direct streams of compressed air against said sheet material for urging said sheet material toward the drum.

6. Apparatus according to claim 5, wherein said guide means comprise channel members having a bottom surface for slidably supporting said sheet material, and flange members spaced from said bottom surface and extending generally parallel thereto for retaining said sheet material in the guide means.

7. Apparatus according to claim 1, wherein said nozzle means comprise at least one jet for directing compressed air against the surface of the drum to urge the leading end of the sheet material against the drum.

8. Apparatus according to claim 7, further including means for operating said cutoff means after a leading end of said sheet material is urged against the drum by air issuing from said nozzle means, whereby the end of the severed sheet is caused to follow the surface of the rotating drum to draw the balance of the sheet outwardly from said guide means and onto the drum.

9. Apparatus for automatically inserting a separator sheet between concentric layers of an optical waveguide being wound upon a drum, comprising:

a supply roll of separator sheet material;

advancing means for frictionally engaging and advancing the sheet material along a path in increments generally corresponding to the peripheral length of said layers of waveguides;

sensing means responsive to the laterial position of the optical waveguide being wound upon the drum for producing an enabling signal when the waveguide attains a predetermined position;

cutoff means disposed along said path and responsive to said enabling signal for severing said sheet material;

elongate guide means extending from said cutoff means to a locus adjacent the drum for retaining a length of sheet material therein and conducting an advancing end of the sheet material from said cutoff means to the surface of the drum;

nozzle means disposed adjacent the drum for directing a stream of compressed air against an extending end of said sheet material to urge said sheet material into frictional contact with the drum;

whereby upon severance by said cutoff means the sheet material is allowed to rotate with the drum and be overlain by the optical waveguide.

10. Apparatus according to claim 9, further including second nozzle means disposed adjacent said guide means for urging said separator sheet material along said guide means.

11. Apparatus according to claim 10, further including second guide means disposed intermediate said advancing means and said cutoff means for conducting advancing sheet material to said cutoff means.

12. Apparatus according to claim 11, wherein said cutoff means comprises a shear for severing said sheet material transversely of the direction of its advance.

* * * * *